United States Patent [19]

Utsch et al.

[11] 4,250,898

[45] Feb. 17, 1981

[54] CARBON DIOXIDE IMPREGNATION OF TOBACCO BY SUPER COOLING

[75] Inventors: Francis V. Utsch, Chester; Roger Z. de la Burde, Powhatan; Patrick E. Aument, Hopewell, all of Va.

[73] Assignee: Philip Morris Incorporated, New York, N.Y.

[21] Appl. No.: 951,072

[22] Filed: Oct. 13, 1978

[51] Int. Cl.[3] ..... A24B 3/18

[52] U.S. Cl. ..... 131/140 P

[58] Field of Search ..... 131/140 P, 121, 140 R, 131/120, 140 B

[56] References Cited

FOREIGN PATENT DOCUMENTS 1444309 7/1976 United Kingdom ..... 131/140 P

*Primary Examiner*—V. Millin

*Attorney, Agent, or Firm*—Watson, Leavenworth, Kelton & Taggart

[57] ABSTRACT

A process for impregnating tobacco with carbon dioxide is provided. The process comprises: (a) contacting tobacco with carbon dioxide gas at relatively low pressure (b) rapidly cooling the tobacco-carbon dioxide system until the carbon dioxide condenses as liquid or solid within the tobacco and finally solidifies, and (c) releasing the pressure in the cooled system. Thereafter, the carbon dioxide-treated tobacco may be expanded conventionally, such as by subjecting it to heating conditions effective to liberate the carbon dioxide therein.

8 Claims, No Drawings

CARBON DIOXIDE IMPREGNATION OF TOBACCO BY SUPER COOLING

BACKGROUND OF THE INVENTION

Various processes have been proposed for expanding tobacco wherein the tobacco is impregnated with or otherwise treated with various agents and then subjected to an expansion treatment. For example, tobacco has been contacted with a gas under somewhat greater than atmospheric pressure, followed by a release of the pressure, whereby the tobacco cells are expanded to increase the volume of the treated tobacco. Other methods which have been employed or suggested have included the treatment of tobacco with various liquids, such as water or relatively volatile organic liquids, to impregnate the tobacco with the same, after which the liquids are driven off to expand the tobacco. Additional methods which have been suggested have included the treatment of tobacco with solid materials which, when heated, decompose to produce gases which serve to expand the tobacco. Other methods include the treatment of tobacco with gas-containing liquids, such as carbon dioxide-containing water, under pressure to incorporate the gas in the tobacco and then the tobacco impregnated therewith is heated or the pressure thereon is reduced to thereby expand the tobacco. Additional techniques have been developed for expanding tobacco which involve the treatment of tobacco with gases which react to form solid chemical reaction products within the tobacco, which solid reaction products may then decompose by heat to produce gases within the tobacco which cause expansion of the tobacco upon their release. More specifically:

A patent to Wilford J. Hawkins, U.S. Pat. No. 1,789,435, granted in 1931, describes a method and apparatus for expanding the volume of tobacco in order to make up the loss of weight caused in curing tobacco leaf. To accomplish this object, the cured and conditioned tobacco is contacted with a gas, which may be air, carbon dioxide or steam under about 20 pounds of pressure and the pressure is then relieved, whereby the tobacco tends to expand. The patent states that the volume of the tobacco may, by that process, be increased to the extent of about 5–15%.

An alien property custodian document No. 304,214 to Joachim Bohme, dated 1943, indicates that tobacco can be expanded using a high-frequency generator but that there are limitations to the degree of expansion which can be achieved without affecting the quality of the tobacco.

A patent to Frank J. Sowa, U.S. Pat. No. 2,596,183, granted in 1952, sets forth a method for increasing the volume of shredded tobacco by adding additional water to the tobacco to cause the tobacco to swell and thereafter heating the moisture-containing tobacco, whereby the moisture evaporates and the resulting moisture vapor causes expansion of the tobacco.

A series of patents to Roger Z. de la Burde, U.S. Pat. Nos. 3,409,022, 3,409,023, 3,409,027 and 3,409,028, granted in 1968, relate to various processes for enhancing the utility of tobacco stems for use in smoking products by subjecting the stems to expansion operations utilizing various types of heat treatment or microwave energy.

A patent to John D. Hind, U.S. Pat. No. 3,425,425, granted in 1969, which is assigned to the same assignee as the assignee of the present invention, relates to the use of carbohydrates to improve the puffing of tobacco stems. In that process, tobacco stems are soaked in an aqueous solution of carbohydrates and then heated to puff the stems. The carbohydrate solution may also contain organic acids and/or certain salts which are used to improve the flavor and smoking qualities of the stems.

A publication in the "Tobacco Reporter" of November 1969 by P. S. Meyer describes and summarizes tobacco puffing or expansion procedures or investigations for expanding and manipulating tobacco for purposes of reducing costs and also as the means for reducing the "tar" content by reduction in the delivery of smoke. Mention is made in this publication of puffing tobacco by different procedures including the use of halogenated hydrocarbons, low pressure or vacuum operation, or high pressure steam treatment that causes leaf expansion from inside the cell when outside pressure is suddenly released. Mention is also made in this publication of freeze-drying tobacco which can also be employed to obtain an increase in volume.

Since the above-mentioned "Tobacco Reporter" article was published, a number of tobacco expansion techniques, including some of the techniques described in the article, have been described in patents and/or published patent applications. For example, U.S. Pat. No. 3,524,452 to Glenn P. Moser et al. and U.S. Pat. No. 3,524,451 to James D. Frederickson, both issued in 1970, relate to the expansion of tobacco using a volatile organic liquid, such as a halogenated hydrocarbon.

U.S. Pat. No. 3,734,104 to William M. Buchanan et al., which is assigned to the same assignee as the assignee of the present invention, issued in 1973, relates to a particular process for the expansion of tobacco stems.

U.S. Pat. No. 3,710,802 to William H. Johnson, issued in 1973 and British Specification 1,293,735 to American Brands, Inc., published in 1972, both relate to freeze-drying methods for expanding tobacco.

South African applications 70/8291 and 70/8292 to R. J. Reynolds Tobacco Company, both filed in 1970, relate to tobacco expansion employing chemical compounds which decompose to form a gas or with inert solutions of a gas under pressure to maintain the gas in solution until it impregnates the tobacco.

A patent to Robert G. Armstrong et al., U.S. Pat. No. 3,771,533, issued in 1973, which is assigned to the same assignee as the assignee of the present invention, involves a treatment of tobacco with carbon dioxide and ammonia gases, whereby the tobacco is saturated with these gases and ammonium carbonate is formed in situ. The ammonium carbonate is thereafter decomposed by heat to release the gases within the tobacco cells and to cause expansion of the tobacco.

Despite all of the above-described advances in the art, no completely satisfactory process has been found. The difficulty with the various earlier suggestions for expanding tobacco is that, in many cases, the volume is only slightly or at best only moderately increased. For example, freeze-drying operations have the disadvantages of requiring elaborate and expensive equipment and very substantial operating costs. With respect to the teaching of using heat energy, infrared or radiant microwave energy to expand tobacco stems, the difficulty is that while stems respond to these heating procedures, tobacco leaf has not generally been found to respond effectively to this type of process.

The use of special expanding agents, for example, halogenated hydrocarbons, such as are mentioned in the Meyer publication for expanding tobacco, is also not completely satisfactory, because some of the materials employed are not always desired as additives. Furthermore, the introduction, in considerable concentration, of materials which are foreign to tobacco presents the problem of removing the expansion agent after the treatment has been completed in order to avoid affecting aroma and other properties of the smoke due to extraneous substances used or developed from the combustion of the treated tobacco.

The use of carbonated water has also not been found to be effective.

While the method of employing ammonia and carbon dioxide gases is an improvement over the earlier described methods, it is not completely satisfactory under some circumstances, in that undesired deposition of salts can result during the process.

Carbon dioxide has been used in the food industry as a coolant and, more recently, has been suggested as an extractant for food flavors. It has also been described in German Offenlegungsschrift 2,142,205 (Anmeldetag; 23 August 1971) for use, in either gaseous or liquid form, to extract aromatic materials from tobacco. However, there has been no suggestion, in connection with these uses, of the use of gaseous carbon dioxide for the expansion of these materials.

A process employing liquid carbon dioxide has been found to overcome many of the disadvantages of the abovementioned prior art processes. The expansion of tobacco, using liquid carbon dioxide is described in Belgium Patent 821,568, which corresponds to U.S. application Ser. No. 441,767 to de la Burde and Aument and is assigned to the same assignee as the present application and in Belgium Patent 825,133 to Airco, Inc. This process may be described as a process for expanding tobacco comprising the steps of (1) contacting the tobacco with liquid carbon dioxide ($CO_2$) to impregnate the tobacco with the liquid carbon dioxide, (2) subjecting the liquid carbon dioxide-impregnated tobacco to conditions such that the liquid carbon dioxide is converted to solid carbon dioxide and (3) thereafter subjecting the solid carbon dioxide-containing tobacco to conditions whereby the solid carbon dioxide is vaporized to cause expansion of the tobacco. Improvements in this last process are described in U.S. application Ser. No. 822,793 to Sykes et al., assigned to the same assignee as the instant application. According to various embodiments of the invention described in this last application, the moisture content of the tobacco employed in the first step of the basic process is controlled and/or the excess liquid carbon dioxide is drained off after the first step and before step 2 and/or the output moisture of the product recovered from the third step of the basic process is controlled.

In earlier work with gaseous $CO_2$, at pressures of about 100 psia, it was found that only minute amounts of carbon dioxide gas could be incorporated in the tobacco and held there sufficiently long for the tobacco to be heated and expanded. Thus, no substantial improvement over the prior art was found and gaseous $CO_2$ was, therefore, believed to be much less effective as an expanding agent than the liquid carbon dioxide employed in the expansion process of the above-mentioned U.S. application Ser. No. 441,767. In copending U.S. application Ser. No. 891,468 to de la Burde et al., assigned to the same assignee as the instant application, a process is described wherein gaseous carbon dioxide remains in the tobacco in an amount of one percent or more to form a product which can thus be expanded. That process may be described as follows: A process for expanding tobacco to achieve at least about 50 percent increase in cylinder volume, comprising the steps of (1) impregnating tobacco with gaseous carbon dioxide under a pressure of at least about 250 psig and at sufficient temperature that substantially all of the carbon dioxide is maintained in gaseous form, (2) decreasing the pressure on the carbon dioxide-impregnated tobacco and (3) heating the impregnated tobacco under conditions effective to liberate the carbon dioxide therein so as to cause expansion of the tobacco. Copending U.S. application Ser. No. 891,290 to Utsch and assigned to the same assignee as the instant application, describes an improvement in this last process whereby the gaseous carbon dioxide remains in the tobacco in an amount of as high as three percent or more to form a product which can then be expanded. This improvement comprises cooling the gaseous carbon dioxide and tobacco system in step (1) above to a temperature close to the saturation temperature of carbon dioxide but not lower than −23° C. The conditions during this cooling are such that the carbon dioxide is not condensed to any significant degree, but rather remains substantially in the gaseous state.

We have now found that satisfactory impregnation of tobacco with carbon dioxide can be achieved employing relatively low pressures followed by supercooling. Unexpectedly superior results and advantages can be achieved upon expansion of tobacco impregnated with carbon dioxide in the manner set forth in the present specification.

BRIEF SUMMARY OF THE INVENTION

A method for impregnating tobacco with carbon dioxide at relatively low pressures is provided. In accordance with the invention, tobacco may be contacted with carbon dioxide gas at relatively low pressures, such as 250 psig or lower. Thereafter, the carbon dioxide/tobacco system is cooled until the carbon dioxide partially condenses and solidifies in the tobacco, whereupon the pressure of the system is released.

During at least the initial portion of the cooling stage, the pressure of the system may be kept constant by continuing to introduce gas into the system, whereby a greater degree of expansion may be effected. Tobacco impregnated in accordance with this invention may be expanded using conventional techniques, such as rapid heating.

DETAILED DESCRIPTION OF THE INVENTION

This invention relates to a means for impregnating tobacco with carbon dioxide and to a process for the expansion of a tobacco product employing carbon dioxide as the expansion agent. Broadly, the process comprises contacting tobacco with gaseous carbon dioxide at a pressure of at least 50 psig; rapidly cooling the carbon dioxide/tobacco system to a temperature where the carbon dioxide condenses to solid or liquid and finally solidifies within the tobacco; and releasing the pressure of the system. The thus impregnated tobacco is then expanded, typically by subjecting it to heating conditions effective to liberate the carbon dioxide.

In general, in the practice of the process of the invention, a pressure vessel or compartment is employed which has a means for loading and unloading the tobacco charge, inlet and outlet lines for gas, and capacity to withstand the maximum intended operating pressure and minimum temperature. The tobacco filler to be treated is charged to the vessel. The tobacco-containing vessel may then be purged with carbon dioxide, although this is not essential to the invention. Thereafter, the pressure of carbon dioxide is increased to the desired impregnating pressure. The vessel may then be immediately closed and cooled or may be cooled for a period while carbon dioxide gas is introduced, whereupon the vessel is closed and cooling continued. The cooling continues until the gaseous carbon dioxide has largely condensed to liquid or solid carbon dioxide and the liquid has in turn solidified within the tobacco. After cooling, the vessel is vented to further reduce the pressure. The impregnated tobacco is thereupon transferred to an expansion system where it is subjected to conditions effective to liberate the carbon dioxide therein so as to cause expansion of the tobacco.

The tobacco to be treated by the process of this invention is typically tobacco filler having a moisture content of 8 to 25%, preferably between 10 and 15%. As used herein, % moisture may be considered equivalent to (OV) since not more than about 0.9% of the tobacco weight is volatiles other than water. Oven volatiles determination is a simple measurement of weight loss on exposure in a circulating air oven for three hours at 100° C.

The process of the present invention may be used to treat either whole cured tobacco leaf, tobacco in cut or chopped form or selected parts of tobacco, such as tobacco stems or may be reconstituted tobacco. In comminuted form, the tobacco to be treated may have a particle size of from about 10 to about 100 mesh, but is preferably not smaller than about 30 mesh.

The tobacco may be introduced into the pressure vessel in a wire cage or on a platform positioned within the vessel or in containers designed to facilitate the rapid introduction and removal of tobacco filler. Such designs are well known to those in the field.

Following introduction of the tobacco, the vessel may be closed except for the inlet and outlet ports to permit purging with carbon dioxide gas. The benefits of purging are the removal of gases which might interfere with a carbon dioxide recovery process and/or might interfere with full penetration of the gaseous carbon dioxide. As an alternative to purging with carbon dioxide gas, the vessel may be evacuated prior to introduction of the carbon dioxide gas.

Either with or without preliminary purging or evacuation of the vessel, carbon dioxide gas is fed to the vessel under conditions whereby the carbon dioxide gas pressure in the vessel is increased to about 50 to 250 psig and preferably to at least 70 psig. Generally, pressures of no more than 250 psig are required for effective impregnation. Since the processing requires gaseous $CO_2$, the temperature should be above 0° C. and below 38° C., more preferably 10° to 20° C.

Upon reaching the desired pressure, the vessel may be closed and the cooling stage begun. During the cooling stage, the vessel is cooled until a portion of the carbon dioxide gas condenses and then solidifies within the tobacco.

This typically requires cooling the vessel and its contents to achieve about 15–25 psig for 1 to 10 minutes depending on the size of vessel and charge, starting pressure and other factors. Most effective impregnation is accomplished when the vessel is cooled to achieve about atmospheric pressure in about 1 to 10 minutes, or until the pressure on the vessel drops below 70 psig or more preferably below 20 psig where most of the $CO_2$ should be converted to solid and excessive loss of $CO_2$ will not occur on venting the vessel to atmospheric pressure.

In an alternative embodiment, the vessel is not closed completely immediately upon commencing cooling, but rather the inlet port remains open to permit continued introduction of carbon dioxide gas during the initial part of the cooling stage, generally for 5 to 15 minutes at temperatures above the liquefaction temperature of $CO_2$ at vessel pressure. The continued introduction of gas serves to maintain the pressure in the vessel, between about 80 to 250 psig, whereby more gas is available for impregnation of the tobacco. Best results are generally obtained when the carbon dioxide is introduced for an additional 5 minutes at a pressure sufficient to maintain the pressure in the vessel at its initial pressure. After that time, the gas introduction is discontinued, the vessel is closed and the cooling stage is continued until the carbon dioxide has condensed and solidified as described above, generally for a period of about 1 to 10 minutes.

The cooling stage of the process is preferably effected by employing a vessel or chamber having a jacket or other means for circulating a refrigerant around the vessel. The vessel is cooled by introducing a low-temperature liquid, such as liquid nitrogen, or methanol or acetone chilled with dry ice to −70° C. or below into the jacket or cooling system of the vessel. Alternatively, the vessel might be cooled by immersion in such a liquid, or liquid nitrogen could be introduced into the vessel.

When the cooling stage has been completed, the outlet valve is opened or the system is otherwise vented to release the pressure in the system and preferably to reduce the pressure to atmospheric pressure. As indicated above, cooling will generally be continued until the pressure has dropped to no more than 15 psig and preferably to no more than 5 psig. Venting generally takes from about 30 seconds to 10 minutes depending on the pressure and size of the vessel, and should preferably take no more than 2 minutes at which point the temperature in the vessel would generally be no more than about −79° C. at atmospheric pressure.

After venting, the resulting carbon dioxide-treated tobacco is transferred to a zone where it is exposed to expansion conditions, by subjecting it to heat or the equivalent in order to rapidly vaporize and remove the carbon dioxide from the tobacco. This may comprise the use of hot surfaces, or a stream of hot air, a mixture of gases and steam, or exposure to other energy sources, such as microwave energy or infrared radiation. It has been found that the use of a gas composition comprising at least 50% (by weight) of steam, and preferably above 80% (by weight) of steam, provides particularly satisfactory results. A convenient means of expanding the carbon dioxide-containing tobacco is to place it or to entrain it in a stream of heated gas, such as superheated steam or to place it in a turbulent air stream maintained, for example, at a temperature of from about 150° to about 260° C. (as low as 100° C. and as high as 370° C.) for a period of about 1 second to 10 minutes. The impregnated tobacco may also be heated by being placed on a moving belt and exposed to infrared heating, by exposure in a cyclone dryer, by contact in a tower with superheated steam or a mixture of steam and air or the like. Any such contacting steps should not raise the temperature of the atmosphere with which the tobacco is in contact to above about 370° C. and should preferably be from about 100° to about 300° C., most preferably 150° to 260° C. when conducted at atmospheric pressure.

As is well known in the processing of any organic matter, overheating can cause damage, first to color, such as undue darkening, and finally, to the extent of charring. The necessary and sufficient temperature and exposure time for expansion without such damage is a function of these two variables as well as the state of subdivision of the tobacco. Thus, to avoid undesirable damage in the heating step, the impregnated tobacco should not be exposed to the higher temperature levels, e.g., 370° C., longer than 1 to 2 seconds.

One method for causing the expansion of the tobacco cells is to use the radiation methods described in either U.S. Pat. Nos. 3,409,022 or 3,409,027. In this operation, the tobacco never attains a temperature above about 140° C., being cooled by the rapid evolution of gases. The presence of steam during heating assists in obtaining optimum results.

Another system, usually preferred, is to use a dispersion dryer, for example, one that is supplied either with steam alone or in combination with air. An example of such a dryer is a Proctor & Schwartz PB dispersion dryer, usually referred to herein as a tower. The temperature in the dryer may range from about 120° to 370° C. with contact time in the dryer of about 1 to 10 seconds. In general, a 1 to 6 second contact time is utilized when the hot gas temperature is 260° to 315° C. or somewhat higher. As stated before, other known types of heating means may be used as long as they are capable of causing the impregnated tobacco to expand without excessive darkening. The presence of a steam atmosphere of 20% or more of the total hot gas composition aids in obtaining the best expansion; a high proportion (e.g., over 80% volume) of steam is preferred.

The rapid heating causes expansion of the tobacco at a temperature where the tobacco is pliable and elastic and the tobacco can be expanded without fracture to an approximation of its green leaf state. A significant and useful degree of expansion is realized.

As described in the examples herein, the degree of expansion is measured in terms of cylinder volume. Cylinder Volume (CV) is determined as follows: Tobacco filler weighing 10.000 g is placed in a 3.358-cm diameter cylinder, vibrated for 30 seconds on a "Syntron" vibrator, and compressed by a 1875-g piston 3.33-cm in diameter for 5 minutes; the resulting volume of filler is reported as cylinder volume. This test is carried out at standard environmental conditions of 23.9° C. and 60% RH; conventionally unless otherwise stated, the sample is preconditioned in this environment for 18 hours. This value depends on the moisture content (OV). In order to bring slightly different OV materials to a comparable basis, the CV value may be adjusted to some specified oven-volatile content, according to the following formula:

$$\text{Corrected CV or CCV} = CV + F\,(OV - OV_s)$$

where $OV_s$ is the specified OV and F is a correction factor (volume per %) predetermined for the particular type of tobacco filler being dealt with. CV and CCV are expressed in cc/10 grams. The method for cylinder volume measurement is described in Wakeham et al., "Filling Volume of Cut Tobacco and Cigarette Hardness," Tobacco Science, Volume XX, pages 157–160 (1976), the disclosures of which are incorporated herein by reference.

The temperature at which the impregnated tobacco is maintained prior to the expansion or rapid heating step will largely govern how long the $CO_2$ remains in the tobacco in sufficient quantity to cause the desired expansion. If there is little insulation or means to keep the temperature down, the transfer should be rapid, preferably less than a few minutes. An insulated "bulking" container is preferred to accomplish the transfer. Supplementary cooling may also be provided as, for example, by applying crushed or powdered dry ice or by spraying liquid nitrogen on the impregnated tobacco.

Unless otherwise indicated, all percentages used herein are by weight. The following examples are illustrative:

EXAMPLE 1

Twenty-five grams of cured, filler-cut bright tobacco at 12% OV was placed in a Parr bomb. The unit was covered, and after purging with carbon dioxide, the operator increased the pressure to 100 psig. The bomb was lowered into a dry ice-methanol bath, which was at −80° C. The pressure dropped in 1 minute to 60 psig, the triple point pressure for $CO_2$. After a brief rebound in pressure, probably reflecting the $CO_2$ phase change, the pressure continued to drop to 10 psig in three minutes. The pressure was then released, and the impregnated filler was processed promptly through a 3-inch diameter expansion tower having upward steam flow at about 150 ft./sec. at 316° C. The resulting expanded filler had a cylinder volume of 55 cc/10 g at 12% OV (62.5 cc/10 g at 11% OV). Microscopic examination of the filler indicated many particles were well expanded (see Table 1).

EXAMPLE 2

A second sample of the same tobacco was placed in a bomb as in Example 1; and after the purge, the $CO_2$ pressure was increased to 100 psig and held for four minutes without cooling. The pressure was released and the sample removed and passed through the expansion tower under the same conditions. The resulting filler had a CV of 50 at 11% OV (42 at 12%). A few particles were well expanded (see Table 1).

EXAMPLE 3

A third sample of filler-cut bright tobacco, untreated, was processed through the tower of 316° C. There was no visible expansion. The filler had a CV of 40 at 11% OV (see Table 1).

EXAMPLE 4

A fourth sample of bright filler was processed in the Parr bomb as in Example 1, but the pressure was maintained at 100 psig by gradual addition of $CO_2$ during the first five minutes of cooling, so as to prevent pressure drop. The source of $CO_2$ was then closed off, and cooling was continued until the pressure was below 20 psig; the bomb was vented to the atmosphere. Treatment in the expansion tower as in Example 1 gave filler with filling power (CV) of 68 cc/10 g at 11% OV (see Table 1).

TABLE 1

Microscopic Analysis of Expansion (Thickness Measurements)

| Example | Initial Pressure | Final Pressure | % Well Expanded +200μ | % Low Expansion 150-200μ | % No Expansion −150μ |
|---|---|---|---|---|---|
| 1 | 100 | 10 | 40 | 40 | 20 |
| 2 | 100 | 100 | 15 | 50 | 35 |
| 3 | 0 | 0 | 15 | 25 | 60 |
| 4 | 100 | 10 | 70 | 15 | 15 |

What is claimed is:

1. A process for impregnating tobacco with carbon dioxide comprising the steps of:

(a) contacting tobacco with gaseous carbon dioxide at a pressure of at least 50 psig; and (b) rapidly cooling the carbon dioxide/tobacco system to a temperature where much of the carbon dioxide condenses and solidifies within the tobacco.

2. The process of claim 1 wherein the pressure in step (a) is between about 50 and 250 psig.

3. The process of claim 1 wherein the system is cooled to at least −70° C. in step (b).

4. The process of claim 1 wherein the system is cooled in step (b) until the pressure thereof drops to no more than 20 psig.

5. The process of claim 1 which further comprises maintaining the pressure of the system during the initial portion of step (b) by continuing to admit carbon dioxide gas to the system.

6. A process for expanding tobacco comprising the steps of:

(a) contacting tobacco with gaseous carbon dioxide under a pressure of at least 50 psig;

(b) rapidly cooling the carbon dioxide/tobacco system to a temperature where the carbon dioxide condenses and solidifies within the tobacco to accomplish impregnation;

(c) releasing the pressure of the system; and (d) thereafter heating the impregnated tobacco under conditions effective to liberate the carbon dioxide therein so as to cause expansion of the tobacco.

7. The process of claim 6 wherein the pressure is reduced to substantially atmospheric pressure in step (c).

8. The process of claim 6 wherein the tobacco is heated to a temperature between about 100° to 370° C. in step (d).

* * * * *